US008096788B2

(12) United States Patent
Wu

(10) Patent No.: US 8,096,788 B2
(45) Date of Patent: Jan. 17, 2012

(54) PUMP HAVING ADJUSTABLE PUMPING PRESSURES

(76) Inventor: Scott Wu, Taichung Hsien (TW)

( * ) Notice: Subject to any disclaimer, the term of this patent is extended or adjusted under 35 U.S.C. 154(b) by 1018 days.

(21) Appl. No.: 12/025,087

(22) Filed: Feb. 4, 2008

(65) Prior Publication Data

US 2009/0196777 A1 Aug. 6, 2009

(51) Int. Cl.
*F04B 37/00* (2006.01)

(52) U.S. Cl. ..... 417/468; 417/446; 417/529

(58) Field of Classification Search ..... 417/446, 417/467, 468, 528, 529
See application file for complete search history.

(56) References Cited

U.S. PATENT DOCUMENTS 5,435,703 A * 7/1995 Lin ..... 417/428
5,779,457 A * 7/1998 Chuang et al. ..... 417/467

FOREIGN PATENT DOCUMENTS

TW 524274 3/2003

* cited by examiner

*Primary Examiner* — Charles Freay
*Assistant Examiner* — Patrick Hamo
(74) *Attorney, Agent, or Firm* — Alan Kamrath; Kamrath IP Lawfirm, PA

(57) ABSTRACT

A pump having adjustable pumping pressures includes a tube, first and second chambers and a channel extending from the first end to the second end of the tube, and an orifice extending through the tube and opening to the channel. A base connected to the second end of the tube includes a first passage opening to the first and second chambers and a second passage opening to the first passage and the channel. A switching device includes a rod disposed in the channel and a shaft received in the orifice for selectively moving the rod to a first position for permitting air flow through the second passage to the channel and a second position for preventing air flow through the second passage to the channel.

12 Claims, 9 Drawing Sheets

PUMP HAVING ADJUSTABLE PUMPING PRESSURES

BACKGROUND OF THE INVENTION

1. Field of the Invention

The present invention relates to a pump and, in particular, to a pump that has adjustable pumping pressures.

2. Description of the Related Art

Air pumps which have high volume and high pressure setting modes are known. In using the pump, the user usually selects the high volume mode until either the desired pressure is reached or the effort becomes too high for that particular person. Then, the user switches the setting to low volume which causes the effort to decrease dramatically, and the user can continue to pump to the desired pressure.

Taiwan Patent Publication No. 524274 discloses a pump that has selectable high volume and high pressure settings. The pump includes an outer, a middle and an inner tubes 30, 40, 50 coaxially disposed for air flowing therethrough. When in the high volume setting, the outer and inner tubes 30, 50 are opened to the pump head. When in the high pressure mode, a switching device 20 mounted adjacent to a foot pedal blocks the outer tube 30 from permitting airflow to the pump head, thus resulting in only the inner tube 50 being opened to the pump head. Unfortunately, while the user can keep one foot on the pedal and switch the settings with another foot, it is very likely that the user loses his or her balance during manipulation of the switching device. Furthermore, the switching device is easy susceptible to mis-actuation by the user's foot.

The present invention is, therefore, intended to obviate or at least alleviate the problems encountered in the prior art.

SUMMARY OF THE INVENTION

It is therefore an objective of the present invention to provide a pump having selectable high volume and high pressure settings that overcomes the aforementioned problems.

Accordingly, the objective is achieved by providing a pump including a tube, first and second chambers and a channel extending from the first end to the second end of the tube, and an orifice extending through the tube and opening to the channel. A base connected to the second end of the tube includes a first passage opening to the first and second chambers and a second passage opening to the first passage and the channel. A switching device includes a rod disposed in the channel and a shaft received in the orifice for selectively moving the rod to a first position for permitting air flow through the second passage to the channel and a second position for preventing air flow through the second passage to the channel.

Other objectives, advantages, and novel features of the invention will become more apparent from the following detailed description when taken in conjunction with the accompanying drawings.

DETAILED DESCRIPTION OF THE PREFERRED EMBODIMENT EMBODIMENTS

Figure 1:
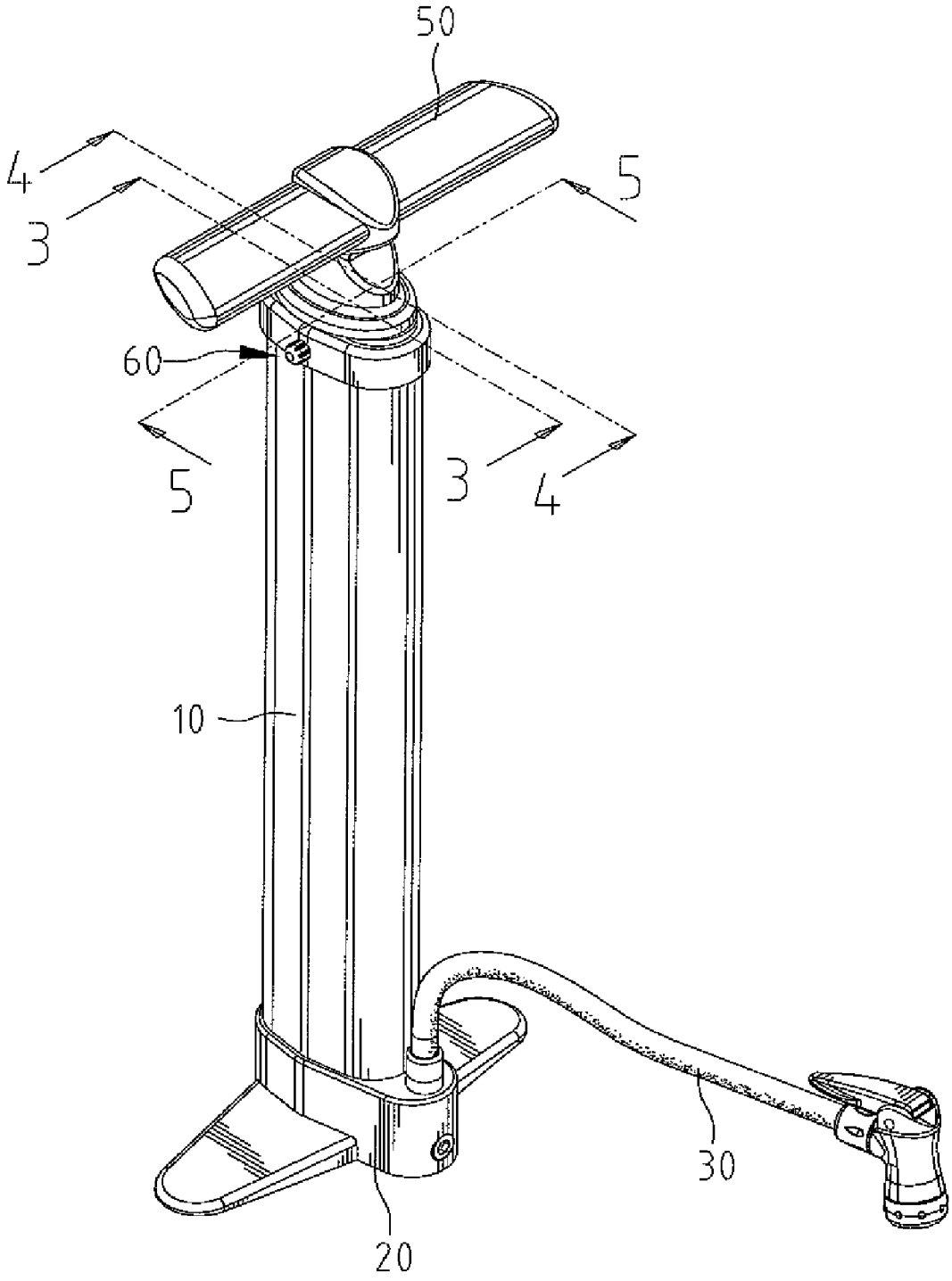
FIG. 1 is a perspective view of a pump in accordance with the present invention.
Figure 2:
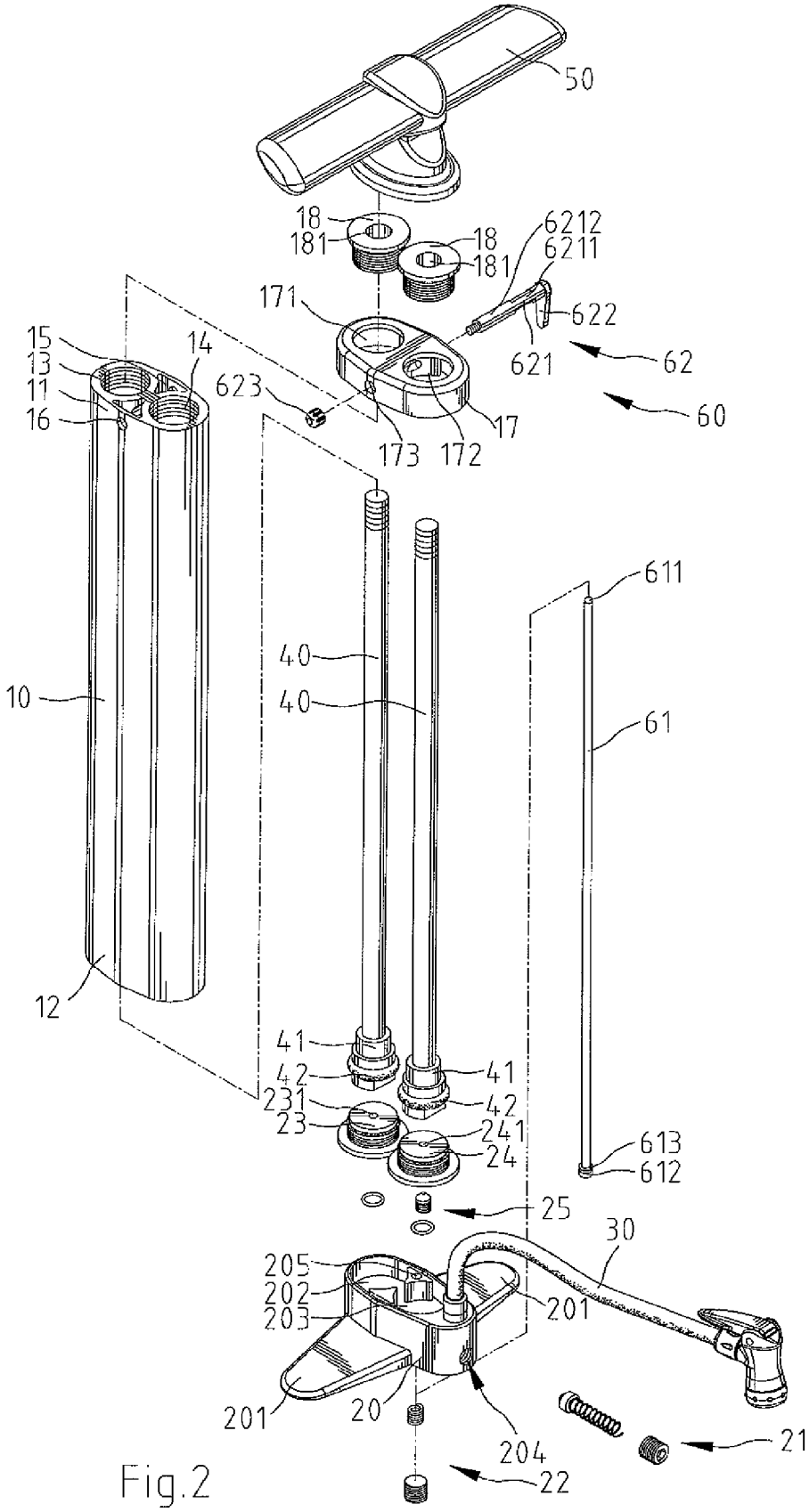
FIG. 2 is an exploded perspective view of the pump shown in FIG. 1.

The first preferred embodiment of the present invention may be understood by referring to FIGS. 1-4. It will be seen that a pump includes a tube 10. A first chamber 13, a second chamber 14 and a channel 15 extend in a parallel relationship from a first end 11 to a second end 12 of the tube 10. An orifice 16 extends transversely through the first end 11 of the tube 10 and through the channel 15. A cover 17, which is attached to the first end 11 of the tube 10, has two holes 171, 172 and a through hole 173 corresponding to and communicating with the first and second chambers 13, 14 and an orifice 16 respectively. A seal 18 includes an end inserted through the hole 171 and threadly engaged with the first chamber 13. Likewise, a seal 18 is inserted through the hole 172 and threadly engages with the second chamber 14.

The first and second chambers 13, 14 respectively receive a rod 40 including an end inserted through and exposed from a through hole 181 of the seal 18 and another end having a piston 41 with an anti-leak member 42 thereon disposed in the associated chamber. The first and second chambers 13, 14 also have two seals 23, 24 respectively threadly engaged therewith at the second end 12 of the tube 10. The seal 23 includes a through hole 231. The seal 24 has a hole 241 and a cavity 242 communicating with the hole 241 and adapted to receive a check valve 25.

A base 20 is connected to the second end 12 of the tube 10 and includes a hose 30 attached thereto and two pedals 201 aligned with one another. The alignment direction is perpendicular to that of the first and second chambers 13, 14 so as to make the user's legs sufficiently clear of the tube 10. The base 20 further includes a first compartment 202 open to the through hole 231 of the seal 23 and a second compartment 203 open to the cavity 242 of the seal 24. The first and second compartments 202, 203 further open to first and second portions 2041, 2042 of a first passage 204 respectively. The first portion 2041 has an internal diameter less than that of the second portion 2042. Moreover, the second portion 2042 of the first passage 204 has a check valve 21 therein for preventing a fluidal flow from the second portion 2042 to the first portion 2041. In addition, the base 20 includes a second passage 205 open to the first portion 2041 of the first passage 204 as well as the channel 15 of the tube 10. The second passage 205 has a check valve 22 disposed therein for preventing fluidal flow from the second passage 205 to ambient.

A handle 50 is connected to each rod 40 so that the user can use the handle 50 to operate the pump.

A switching device 60 includes a rod 61 and a switch 62 which urges the rod 61. The rod 61 is disposed in the channel 15 of the tube 10 and has a first end 611, a second end 612 and an anti-leak member 613 disposed on the second end 612. The switch 62 is disposed in the orifice 16 and includes a shaft 621 abutted against the first end 611 of the rod 61, a handle 622 extended perpendicularly from an end of the shaft 621 to operably move the shaft 621, and a cap 623 connected to another end of the shaft 621 for preventing disengagement of the shaft 621 from the orifice 16. In addition, the shaft 621 has a first portion 6211 and a second portion 6212, with the first portion 6211 having a diameter less than that of the second portion 6212 and with the first portion 6211 eccentrically disposed relative to the second portion 6212.

Figure 3:
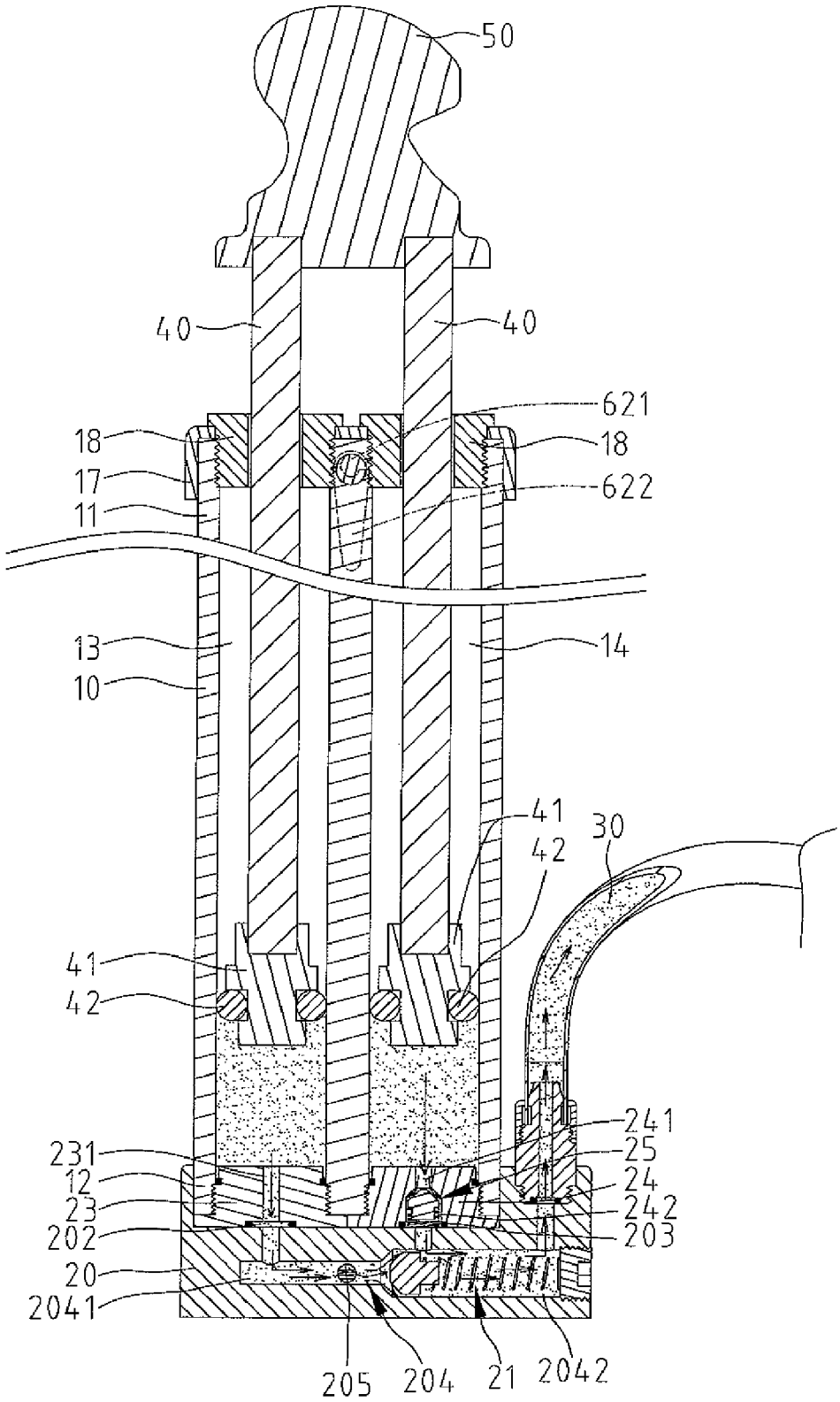
FIG. 3 is a cross-sectional view taken along line 3-3 of FIG. 1.
Figure 4:
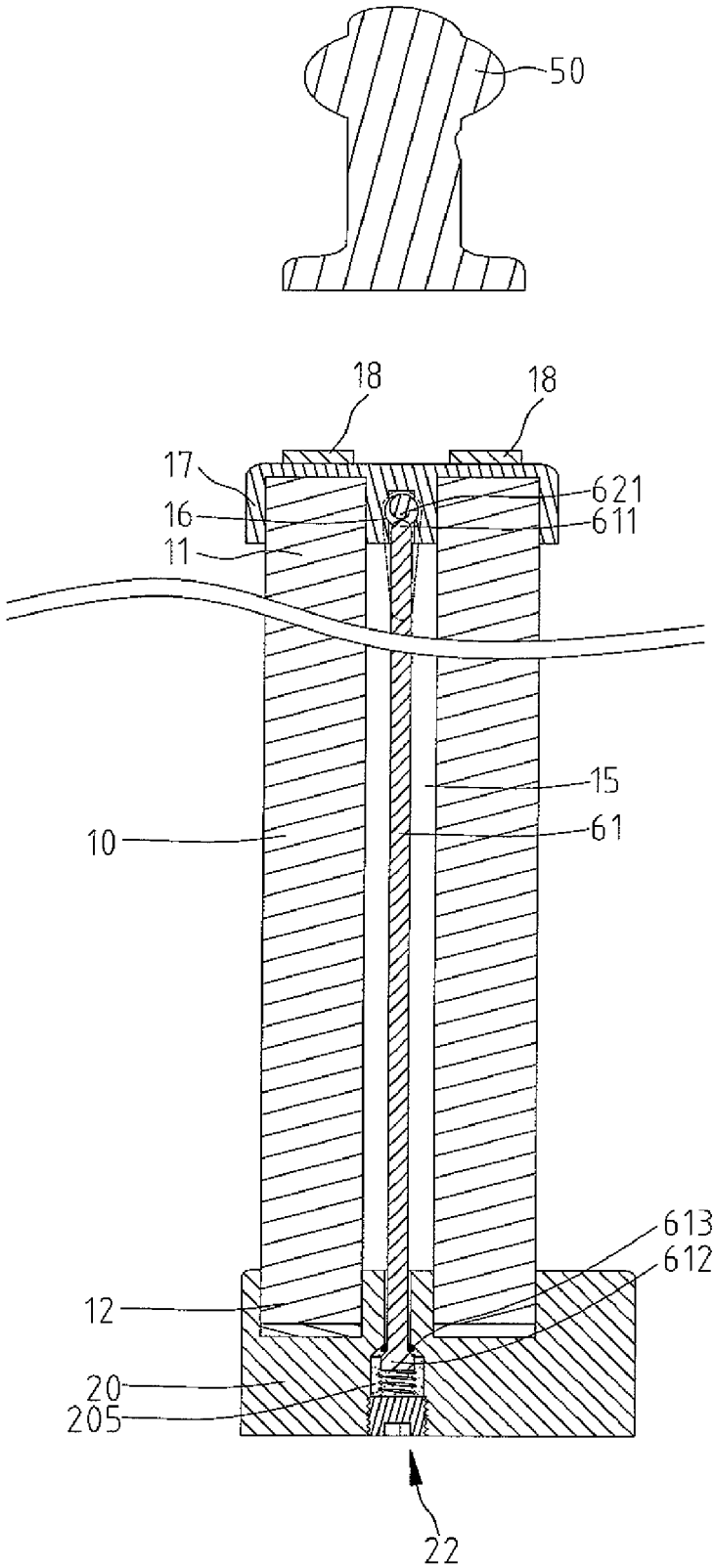
FIG. 4 is a cross-sectional view taken along line 4-4 of FIG. 1.
Figure 5:
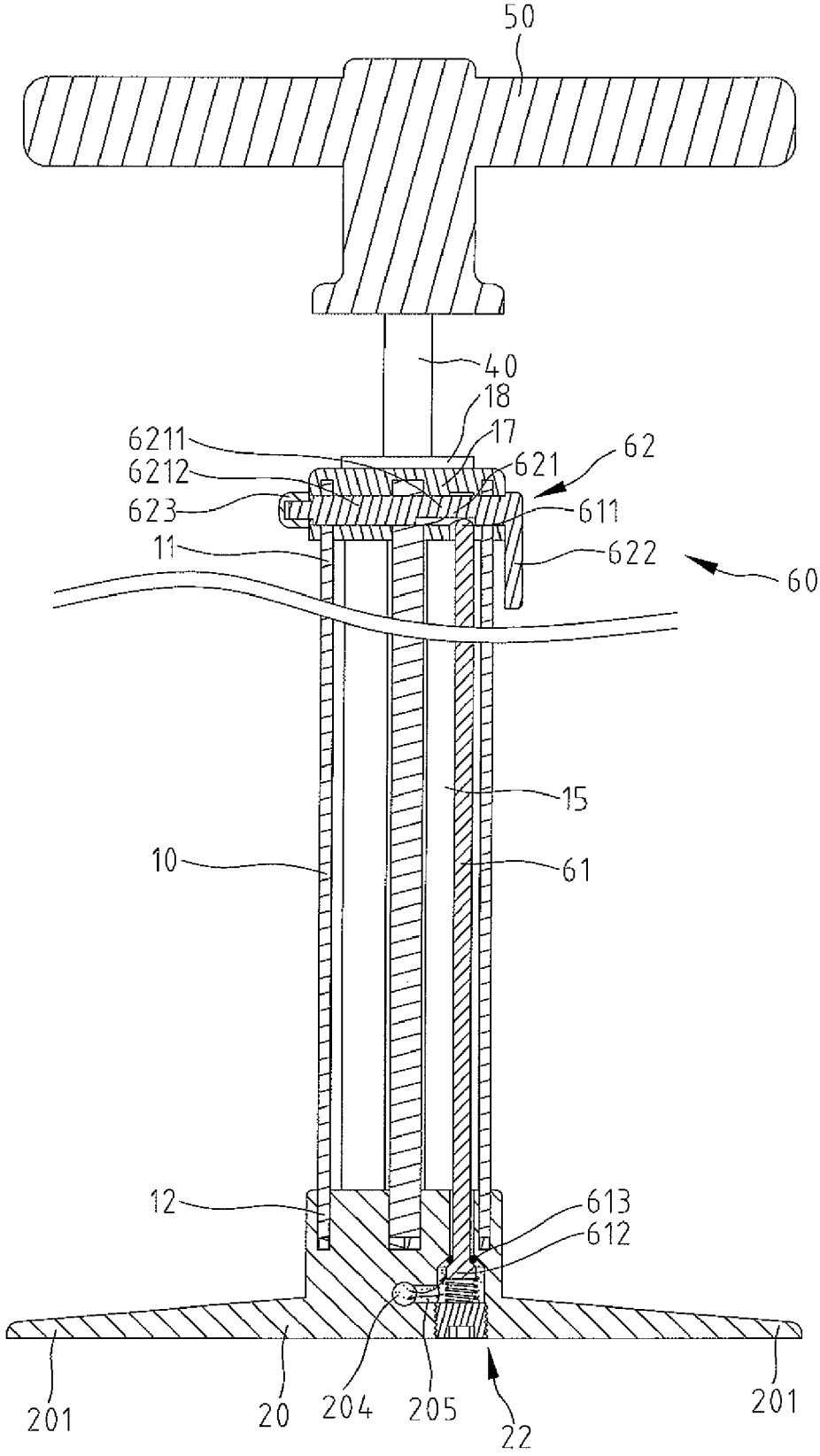
FIG. 5 is a cross-sectional view taken along line 5-5 of FIG. 1.

Referring to FIGS. 3 to 5, when it is intended for a high volume stroke and low pressure, the switching device 60 is in a first position in which the second end 612 of the rod 61 is pushed upward by the check valve 22 to block fluidal communication between the second passage 205 and the channel 15. Thus, when pushing the handle 50 down, air in the first chamber 13 is forced through the through hole 231 of the seal 23 to the first portion 2041 of the first passage 204. Then, air pushes the check valve 21 in the second portion 2042 of the first passage 204 so as to flow to the second portion 2042 and then flow to the hose 30. Furthermore, air in the second chamber 14 is forced through the through hole 241 and the cavity 242 to the second portion 2042 of the first passage 204 and then to the hose 30.

Still referring to FIGS. 3 to 5, the check valve 21 prevents air from flowing from the second portion 2042 to the first portion 2041 of the first passage 204, and the check valve 25 prevents air from flowing from the second portion 2042 of the first passage 204 to the second chamber 14.

Figure 6:
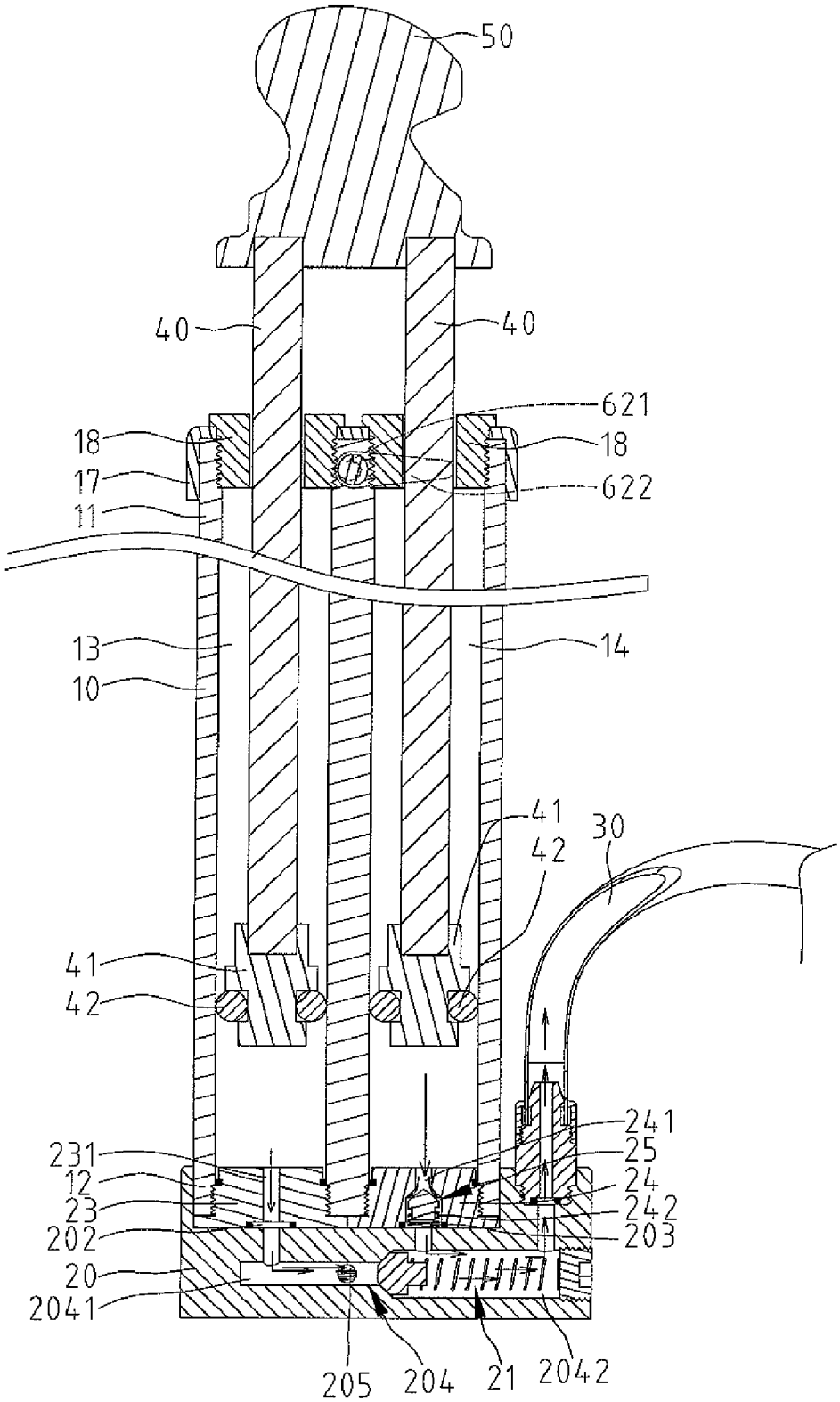
FIG. 6 is similar to FIG. 3, but shows the switching device of the pump in another position.
Figure 7:
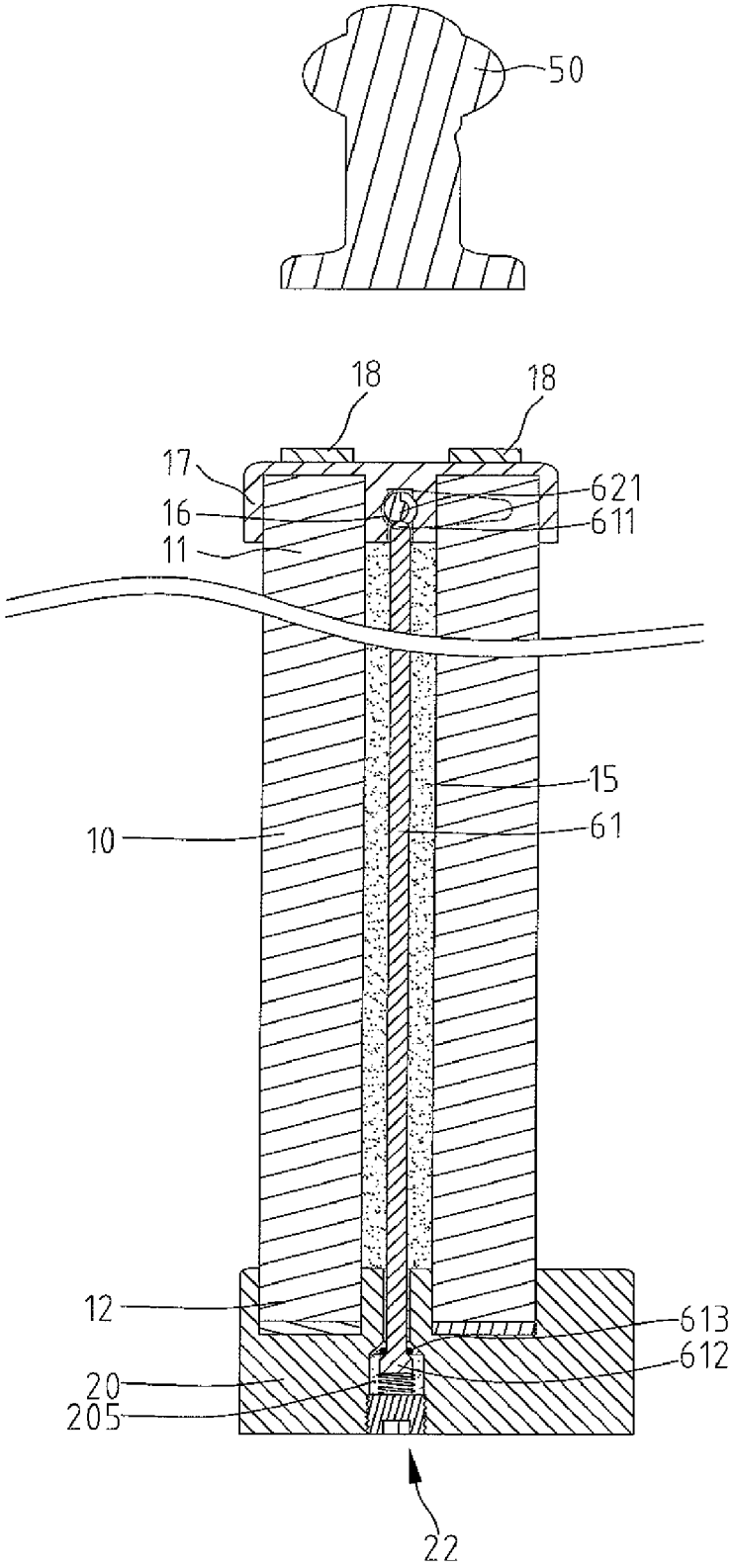
FIG. 7 is similar to FIG. 4, but shows the switching device of the pump in another position.
Figure 8:
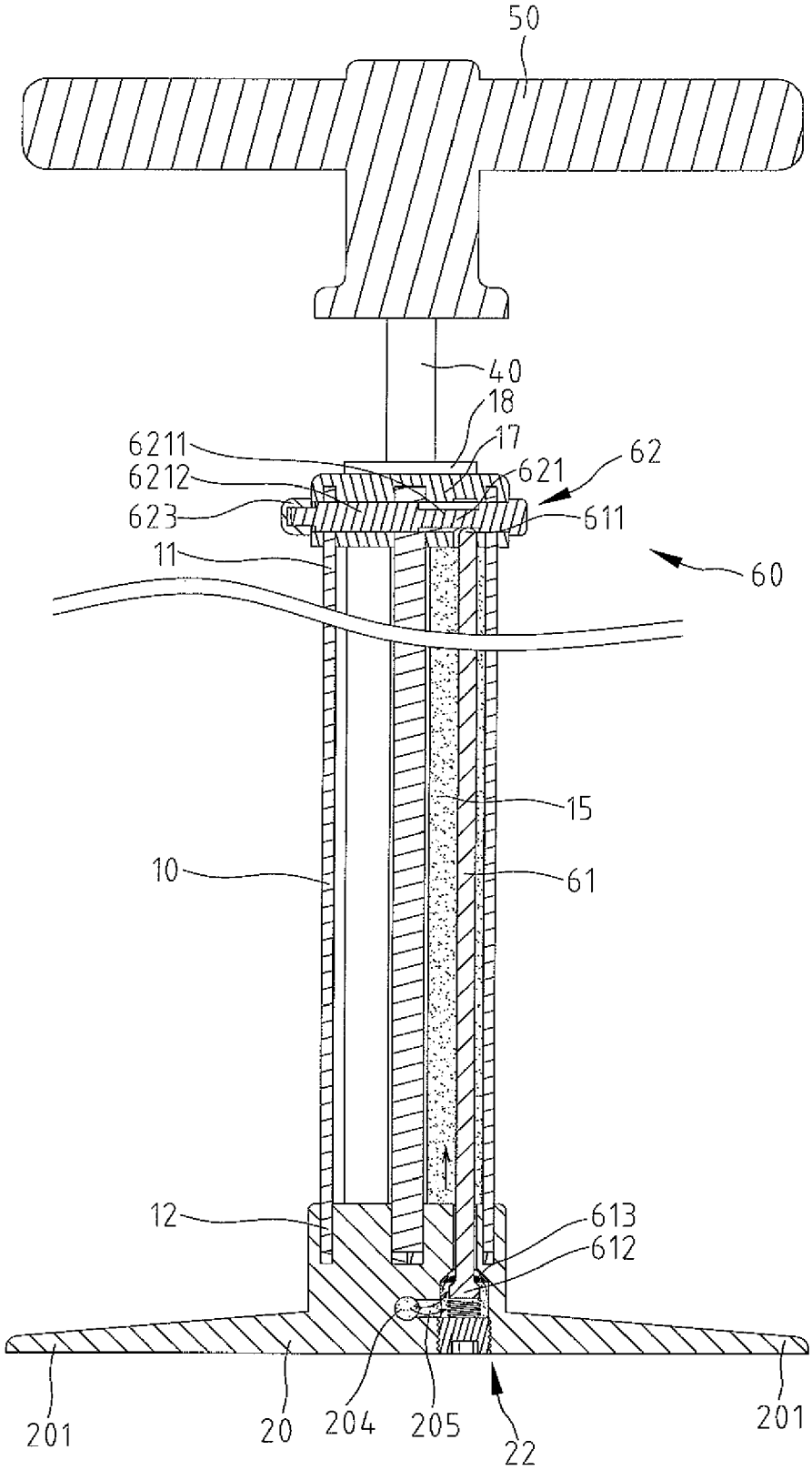
FIG. 8 is similar to FIG. 5, but shows the switching device of the pump in another position.

Referring to FIGS. 6 to 8, when it is intended for a low volume stroke and high pressure, the switching device 60 is in a second position in which the first portion 6211 of the shaft 621 is rotated to push the rod 61 downward to permit fluidal communication between the second passage 205 and the channel 15. When pushing the handle 50 down, air in the first chamber 13 is forced out of the second passage 205 to the channel 15 and then to ambient. Furthermore, air in the second chamber 14 is forced through the through hole 241 and the cavity 242 to the second portion 2042 of the first passage 204 and then to the hose 30.

Figure 9:
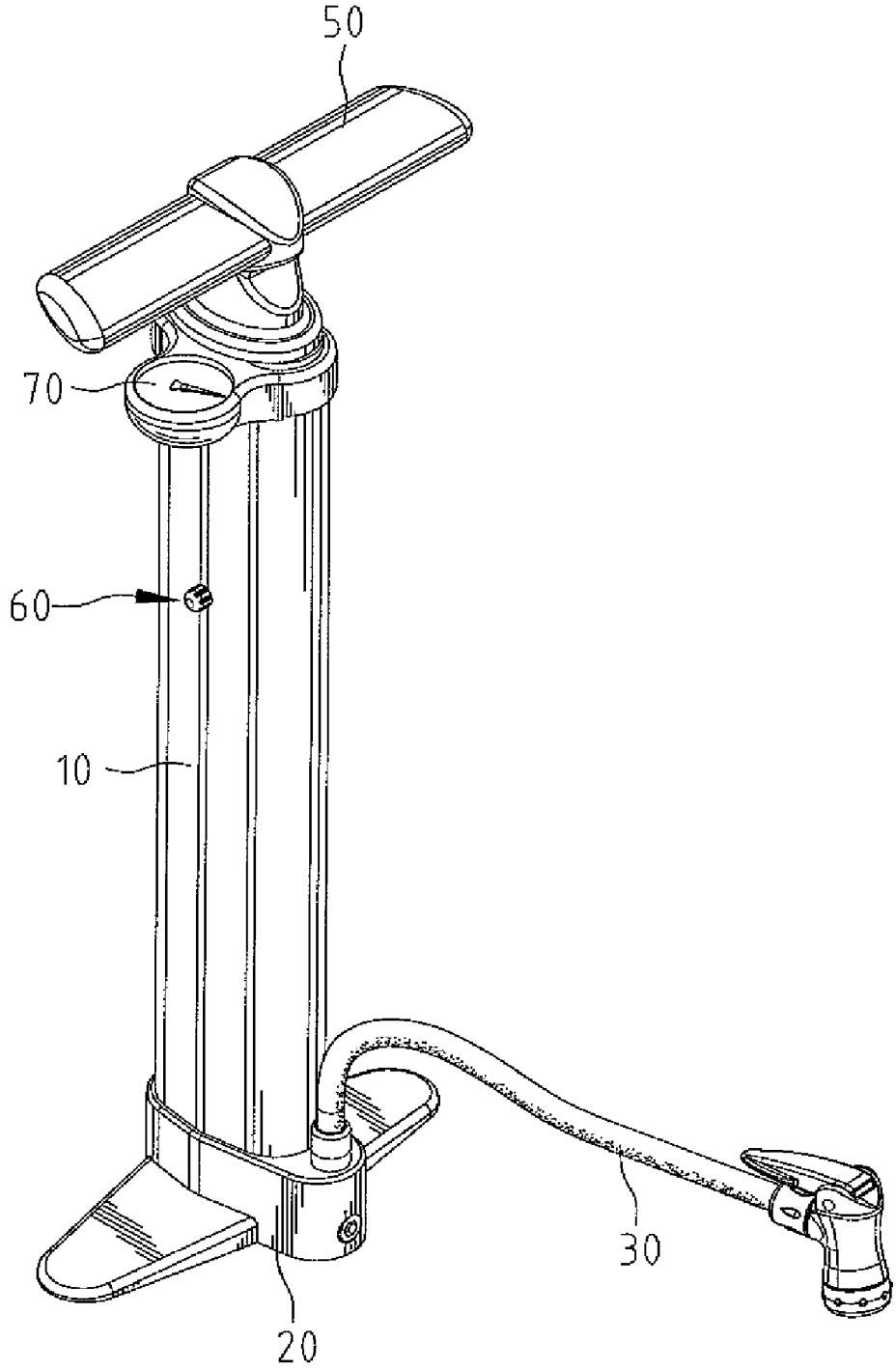
FIG. 9 is a perspective view of a pump in accordance with a second embodiment of the present invention.

FIG. 9 shows a second embodiment of the pump in accordance with the present invention. The operation of the second embodiment in all respect is identical to the prior embodiment, but it includes a pressure gauge 70, and the switch 62 of the switching device 60 is received between the first and second ends 11, 12 of the tube 10.

While the specific embodiments have been illustrated and described, numerous modifications come to mind without significantly departing from the spirit of invention, and the scope of invention is only limited by the scope of accompanying claims.

What is claimed is:

1. A pump as comprising:

a tube having a first end and a second end, first and second chambers extending through the tube, a channel extending through the tube, and an orifice extending through the tube and opening to the channel;

a base connected to the second end of the tube and including a first passage opening to the first and second chambers and a second passage opening to the first passage and the channel;

first and second rods, with the first rod received in the first chamber and the second rod received in the second chamber;

a handle connected to the first and second rods at one end; and a switching device including a switch rod disposed in the channel and a shaft received in the orifice for selectively moving the switch rod to a first position for enabling air flow through the second passage to the channel and a second position for preventing air flow through the second passage to the channel, wherein the shaft comprises a first portion and a second portion, with the first portion having a diameter less than that of the second portion, with the first portion eccentrically disposed relative to the second portion, and with the first portion abutted by the rod.

2. The pump as claimed in claim 1 wherein the first passage comprises a first portion open to the first chamber and a second portion open to the second chamber, and wherein the second portion includes a check valve for selectively preventing a fluidal flow from the first portion to the second portion of the first passage.

3. The pump as claimed in claim 2 wherein the second passage opens to the first portion of the first passage.

4. The pump as claimed in claim 1 wherein the rod comprises a first end abutted by the shaft and a second end that selectively allows a fluidal flow from the second passage to the channel.

5. The pump as claimed in claim 1 wherein the switching device further comprises a handle extended from an end of the shaft and a cap connected to another end of the shaft.

6. A pump comprising:

a tube having a first end and a second end, first and second chambers extending through the tube, a channel extending through the tube, and an orifice extending through the tube and opening to the channel;

a base connected to the second end of the tube and including a first passage opening to the first and second chambers and a second passage opening to the first passage and the channel;

first and second rods, with the first rod received in the first chamber and the second rod received in the second chamber;

a handle connected to the first and second rods at one end;

a switching device including a switch rod disposed in the channel and a shaft received in the orifice for selectively moving the switch rod to a first position for enabling air flow through the second passage to the channel and a second position for preventing air flow through the second passage to the channel; and a cover attached to the first end of the tube, with the cover having two holes and a through hole corresponding to and communicating with the first and second chambers and the orifice respectively.

7. A pump comprising:

a tube having a first end and a second end, first and second chambers extending through the tube, a channel extending through the tube, and an orifice extending through the tube and opening to the channel;

a base connected to the second end of the tube and including a first passage opening to the first and second chambers and a second passage opening to the first passage and the channel, wherein the first passage comprises a first portion open to the first chamber and a second portion open to the second chamber, and wherein the second portion includes a check valve for selectively preventing a fluidal flow from the first portion to the second portion of the first passages wherein the base comprises first and second compartments respectively receiving the first and second chambers, and wherein the first and second chambers comprise seals respectively engaging therewith at the second end of the tube;

first and second rods, with the first rod received in the first chamber and the second rod received in the second chamber;

a handle connected to the first and second rods at one end; and a switching device including a switch rod disposed in the channel and a shaft received in the orifice for selectively moving the switch rod to a first position for enabling air flow through the second passage to the channel and a second position for preventing air flow through the second passage to the channel.

8. The pump as claimed in claim 7 wherein the seal in the first chamber includes a through hole and the seal in the second chamber has a hole and a cavity opening to the hole.

9. The pump as claimed in claim 8 wherein the seal in the second chamber has a check valve disposed in the cavity.

10. The pump as claimed in claim 8 wherein the first portion of the first passage opens to the through hole and the second portion of the first passage opens to the cavity.

11. A pump comprising:

a tube having a first end and a second end, first and second chambers extending through the tube, a channel extending through the tube, and an orifice extending through the tube and opening to the channel;

a base connected to the second end of the tube and including a first passage opening to the first and second chambers and a second passage opening to the first passage and the channel, wherein the base comprises two pedals aligned with one another and perpendicular to an alignment which the first and second chambers orient;

first and second rods, with the first rod received in the first chamber and the second rod received in the second chamber;

a handle connected to the first and second rods at one end; and a switching device including a switch rod disposed in the channel and a shaft received in the orifice for selectively moving the switch rod to a first position for enabling air flow through the second passage to the channel and a second position for preventing air flow through the second passage to the channel.

12. The pump as claimed in claim 11 further comprising a pressure gauge.

* * * * *